US007247079B2

(12) United States Patent
Maar

(10) Patent No.: US 7,247,079 B2
(45) Date of Patent: Jul. 24, 2007

(54) TOY FIGURE, IN PARTICULAR, FUNCTIONAL DOLL

(75) Inventor: Lienhard Maar, Rödental (DE)

(73) Assignee: Zapf Creation AG, Roedental (DE)

( * ) Notice: Subject to any disclaimer, the term of this patent is extended or adjusted under 35 U.S.C. 154(b) by 256 days.

(21) Appl. No.: 10/968,781

(22) Filed: Oct. 19, 2004

(65) Prior Publication Data

US 2005/0054263 A1 Mar. 10, 2005

Related U.S. Application Data

(63) Continuation of application No. PCT/EP03/03728, filed on Apr. 10, 2003.

(30) Foreign Application Priority Data

Apr. 19, 2002 (DE) ..... 102 17 486

(51) Int. Cl.
*A63H 11/00* (2006.01)
*A63H 13/00* (2006.01)
*A63H 3/20* (2006.01)

(52) U.S. Cl. ..... 446/306; 446/330; 446/198

(58) Field of Classification Search ..... 446/176–199, 446/330, 352, 353, 354, 355, 356, 304–306
See application file for complete search history.

(56) References Cited

U.S. PATENT DOCUMENTS 2,021,115 A * 11/1935 Jackson ..... 446/383
2,731,768 A 1/1956 Harrowe
3,464,154 A * 9/1969 Di Leva ..... 446/158
3,594,942 A * 7/1971 Hollingsworth et al. .... 446/198
3,693,292 A 9/1972 Di Leva
4,188,746 A * 2/1980 Wolf ..... 446/198
4,536,165 A * 8/1985 Maar ..... 446/153
4,854,911 A * 8/1989 Berliner et al. ..... 446/376
5,516,322 A 5/1996 Myers
5,795,213 A 8/1998 Goodwin
6,053,799 A * 4/2000 Himstedt ..... 446/381
6,149,491 A * 11/2000 Arad et al. ..... 446/355
6,220,922 B1 * 4/2001 Lee et al. ..... 446/383
6,273,781 B1 * 8/2001 Yamasaki ..... 446/330
2001/0029146 A1 10/2001 Llorens
2005/0085158 A1 * 4/2005 Tsang ..... 446/304

FOREIGN PATENT DOCUMENTS

DE 32 42 178 A1 5/1984
GB 2 158 363 A 11/1985
GB 2 266 847 A 11/1993
WO 03/089093 A1 10/2003

* cited by examiner

*Primary Examiner*—Eugene Kim
*Assistant Examiner*—Urszula M Cegielnik
(74) *Attorney, Agent, or Firm*—Laurence A. Greenberg; Werner H. Stemer; Ralph E. Locher

(57) ABSTRACT

A toy figure, particularly a functional doll, includes a central torso provided with a body shell surrounding a hollow space inside the torso and several extremities such as a head, arms, and legs, which are disposed on the torso. At least the arms and legs are made of a soft elastic material. A functional unit is integrated into the toy figure for ensuring one or several functions that are typical of a functional doll. The arms and/or legs and/or the head are pivotally mounted on the torso through fluid-tight joint connections.

43 Claims, 9 Drawing Sheets

TOY FIGURE, IN PARTICULAR, FUNCTIONAL DOLL

CROSS-REFERENCE TO RELATED APPLICATION

This is a continuing application, under 35 U.S.C. § 120, of copending international application No. PCT/EP03/03728, filed Apr. 10, 2003, which designated the United States; this application also claims the priority, under 35 U.S.C. § 119, of German patent application No. 102 17 486.5, filed Apr. 19, 2002; the prior applications are herewith incorporated by reference in their entirety.

BACKGROUND OF THE INVENTION

Field of the Invention

The invention relates to a toy figure, in particular, a functional doll, including a central torso with a body shell that encloses a cavity in the interior of the torso, and a plurality of extremities that are disposed on the torso, such as a head, arms and legs, at least the arms and legs being formed from flexurally elastic material. A functional device for ensuring one or more functions typical of a functional doll is integrated in the toy figure, the functional alignment including a central functional section that is accommodated in the torso of the toy figure and at least one peripheral functional section that is disposed in an associated extremity.

Toy figures, in particular, so-called functional dolls, in which a series of predetermined functions integrated in the toy figure increase the play value have been available for some time now. For example, dolls that laugh, cry, wet themselves, swallow, and excrete soft food or can make certain sounds are known. It is often the case that these toy figures require batteries. A durable toy figure that is particularly unsusceptible to malfunctioning can be achieved if these functions are triggered mechanically, pneumatically, and/or hydraulically rather than electrically.

SUMMARY OF THE INVENTION

It is accordingly an object of the invention to provide a toy figure, in particular, a functional doll, that overcomes the hereinafore-mentioned disadvantages of the heretofore-known devices of this general type and that further increases the extent of a play value of the toy.

With the foregoing and other objects in view, there is provided, in accordance with the invention, a toy figure, including a central torso having a body shell enclosing a cavity in an interior of the torso, a plurality of extremities disposed on the torso, the extremities including at least one of a head, arms, and legs, at least the arms and the legs being formed from a flexurally elastic material, an integrated functional device having a central functional section disposed in the torso and at least one peripheral functional section disposed in an associated one of the extremities, joint connections rotatably mounting at least one of the arms, the legs, and the head on the torso, at least one of the joint connections having seals fluid-tightly sealing the torso and the at least one of the arms, the legs, and the head, a transfer device guided through at least one of the fluid-tight joint connections, and the at least one peripheral functional section being in at least one of mechanical, pneumatic, and hydraulic operative connection with the central functional section through an associated one of the fluid-tight joint connections.

It is a basic idea of the present invention for such a toy figure equipped with joints and functions to be configured as a doll for playing with in the bath. The provision of suitable sealing measures in the region of the joint connections gives the toy figure a fluid-tight construction. Transfer measures, at the same time, are guided through the fluid-tight joint connection such that at least one peripheral functional section is in mechanical and/or pneumatic and/or hydraulic operative connection with the central functional section through the associated fluid-tight joint connection. The sealing measures in the region of the joint connections prevent water from passing into the hollow torso or the hollow extremities, in particular, the head, the arms, or legs.

It has been found that the conventional toy figures with generic integrated functional devices have the disadvantage that, on account of the joint connections, they were not sufficiently fluid-tight to be brought into contact with water. For the users, predominantly children from three to ten years of age, the play value of a toy figure, in particular, a functional doll, can be significantly increased by it also being possible for this figure or doll to be introduced into a basic of water, in particular, into a bathtub, or even held under running water.

With the conventional functional dolls, in such a case, water penetrates through the joint connections. As a result, the functional device may be damaged, but, at the very least, water remains in the toy figure, which is extremely undesirable for hygiene-related reasons.

In accordance with another feature of the invention, at least two peripheral functional sections are provided in two different extremities that are each in operative connection with the central functional section. Such a peripheral function may be formed, for example, by a compressible chamber that is formed in the arm and the compression of which causes a certain function, in particular, the flow of tears, to be triggered by the functional device. The second peripheral functional section may be configured, for example, as a pressure slide within a flexurally elastic leg, to actuate a valve in the central functional section.

In accordance with a further feature of the invention, for the peripheral functional section to be connected to the central functional section in each case through the fluid-tight joint connections, mechanical and/or hydraulic and/or pneumatic transfer measures that may include, for example, one or more hoses or lines or an actuating slide are provided in the region of these fluid-tight joint connections.

In accordance with an added feature of the invention, first joint elements are provided on the torso and can be brought into engagement with second, respectively correspondingly configured joint elements on the extremities, at least one of the first joint elements including a respective recess that is provided on the torso and into which the second joint elements can be latched. These first joint elements are, preferably, integrally formed on the torso so that this constitutes a favorable solution as far as the production costs are concerned. Furthermore, this solution, in the case of a functional doll, allows realistic modeling of human behavior—as far as the pivoting movement and the pivoting plane of the joint are concerned—to be achieved in a comparatively favorable manner.

In accordance with an additional feature of the invention, the fluid-tight sealing may be effected by forming the first joint elements provided on the torso in each case in a joint cage belonging to the torso and partitioning them off in a fluid-tight manner in the direction of the cavity of the torso in each case by a sealing wall of the associated joint cage. The mechanical and/or pneumatic and/or hydraulic transfer measures are guided through the sealing walls in a fluid-tight mount or fluid-tight sealing being effective between the sealing walls and the second joint elements.

The first joint elements, which are, preferably, likewise integrally formed on the torso, are partitioned off in a cage-like manner from the cavity by the sealing walls. It is also the case in this configuration that the body shell is, preferably, welded together from two parts, with the result that a sufficiently high rear-engagement measures can be formed in the region between the sealing walls and the first joint elements so that the second joint elements can be latched in permanently on the torso. In a specific configuration, it is also possible for the fluid-tight mount mentioned to fix an associated transfer measures, for example, a hose, in a fully fluid-tight manner, in particular, by adhesive bonding or welding. Any rotary movements can, then, be absorbed by twisting of the hose or by a separate rotary bearing.

In accordance with yet another feature of the invention, the fluid-tight mount, itself, is configured as a rotary bearing for ensuring a fluid-tight rotary movement between the sealing wall and the transfer measures. For example, an actuating slide can be mounted in a fluid-tight manner within the sealing wall along the axis of rotation of the joint movement.

In accordance with yet a further feature of the invention, the joint cages that are, preferably, provided act as stiffening measures to effect a sealing fit that is reliable even under stressing. The fluid-tight mounting has to be ensured even when, within the context of customary handling of the toy figure, the extremities are also subjected to transverse forces. In a configuration that is further regarded as advantageous, the sealing walls are, thus, more torsionally rigid than the body shell of the toy figure.

In accordance with yet an added feature of the invention, the joint cages can be inserted as separate components into the torso. As an alternative, the joint cages or two half-shells that form a joint cage can be integrally formed on the torso or on the half-bodies thereof.

If the joint cages are configured as separate components, it is also possible to use, for such a purpose, a material that differs from, in particular, is harder than, the material of the body shell. In the case of the joint cages being integrally formed on the half-bodies of the torso, it is recommended for the joint cages also to be integrally formed as half-shells in each case.

In accordance with yet an additional feature of the invention, at least one peripheral functional section is configured as an actuating device for triggering a certain function of the functional device, in particular—as has already been mentioned—as a compressible chamber, as an eccentric or as a pressure slide.

It is also possible, in accordance with again another feature of the invention, for at least one peripheral functional section to be configured as an effect-producing device, in particular, as a tear outlet and/or as food-/drink-receiver, for ensuring a predetermined play effect. Here too, it is important to have reliable transfer measures, between the central functional section and the peripheral functional section, which are guided through the fluid-tight joint connections and which are configured for the respectively envisaged rotary movements between the torso and extremity. In accordance with again a further feature of the invention, at least one peripheral functional section is three peripheral functional sections disposed in three different ones of the extremities, each of the three peripheral functional sections being in operative connection with the central functional section, and the three different ones of the extremities include the head, one of the arms, and one of the legs In accordance with again an added feature of the invention, for sealing the joint connections, first joint elements are provided on the torso and can be brought into engagement with second, respectively correspondingly configured joint elements on the extremities, annular sealing measures being disposed between at least one first joint element and the associated second joint element and effecting fluid-tight sealing of the respective joint connection even in the case of rotary movement between the first and second joint elements.

This possible sealing method may be provided as an alternative, or in addition, to the already mentioned sealing by the sealing walls in the region of the first joint elements within the torso. A preferred configuration is one that does not have these separately provided sealing walls because there is, then, no need to produce the latter and it is also the case that the transfer measures need not be guided through the sealing walls. The annular sealing measures may be configured here such that it is effective in the region of the bearing surfaces between the first and second joint elements and effects reliable sealing in any envisaged rotary position. To reduce frictional forces and wear and to increase the sealing action, a sealing lubricant, for example, silicone lubrication, may be provided in addition.

In accordance with again an additional feature of the invention, of the first (torso-side) joint elements, the latter include a disk-like base plate that is, preferably, integrally formed with the body shell and has an outer and an inner abutment surface, the base plate containing a recess that is provided for the insertion of the associated second joint element and has a circular inner surface. Accommodating devices for fastening the annular sealing measures are provided on this circular inner surface. This disk-like base plate, in particular, the circular inner surface thereof, defines a stable bearing surface on which the annular sealing measures can be provided at the same time. In a specific configuration, the accommodating devices for the annular sealing measures may include an encircling groove such that the annular sealing measures are retained in position by the encircling groove.

In accordance with still another feature of the invention, the second joint elements are configured to correspond to the first joint elements and may include two mating plates that are spaced apart from one another at a predetermined distance by an encircling joint groove, at least certain portions of the resulting joint groove defining sliding surfaces for the joint connection, and these and/or other portions forming a bearing surface for the annular sealing measures within the joint groove.

In accordance with still a further feature of the invention, the annular sealing measures may be configured as an O-ring. This configuration results in durable and reliable sealing between the first and second joint elements, the elasticity of the O-ring being capable of compensating for production tolerances, deformation and wear.

In accordance with still an added feature of the invention, that is particularly favorable in production terms, the annular sealing measures are configured as an encircling sealing lip that is formed, on the torso side, on the first joint element or the second joint element, which is associated with an extremity, preferably, connected integrally to the first joint element or to the second joint element. Production and installation costs are favorable precisely in the case of integrally forming this sealing lip.

In accordance with still an additional feature of the invention, the annular sealing element may be configured as a cross-sectionally U-shaped double ring or grooved ring with an outer and an inner sealing lip. On account of its elasticity already being provided by the shape, such a sealing element is particularly well suited for compensating for any production tolerances, deformation, or signs of wear.

In accordance with another feature of the invention, the body shell of the torso of the toy figure is formed from two half-bodies that are welded to one another at the manufacturer. This gives the manufacturer more freedom in constructing the body shell. Even undercut regions, in particular, for forming the first joint elements, can, thus, be realized with justifiable production outlay.

In accordance with a further feature of the invention, production of the toy figure by welding two half-bodies is carried out even in the case of the torso having a length of over 150 mm, preferably, of over 160 mm, in particular, of over 170 mm.

In accordance with an added feature of the invention, the reinforcing inserts have an outwardly oriented planar front surface.

In accordance with an additional feature of the invention, the arms and/or legs are stiffened in the region of the joint connections by reinforcing inserts. It is precisely in the case of the flexurally elastic arms and/or legs, which are usually configured as hollow bodies, that there is the problem of these possibly being deformed, under unfavorable loading, such that, without reinforcing inserts, a fluid-tight joint connection possibly cannot be ensured with a sufficient degree of reliability. It is, thus, a particular discovery that the reliability of the fluid-tight joint connection according to the invention, through which transfer measures of a functional unit are guided, can still be increased to a significant extent by reinforcing inserts.

In accordance with yet another feature of the invention, the reinforcing inserts have a cylindrical basic body with a termination plate that is joined thereto and is of slightly larger dimensions in the radial direction. The reinforcing inserts are inserted into a correspondingly configured recess of the associated joint element, this recess being configured as a cylindrical opening that is bounded at the top by an encircling groove. The termination plate reinforces the joint element as far as its distal periphery. Deformation of the flexurally elastic arms and/or legs, then, cannot give rise to any deformation in the region of the joint connections that is critical for the functioning of the fluid sealing.

Although basically not necessarily integral positioning of the first joint element in relation to the torso (and, likewise, not necessarily integral positioning of the second joint element in relation to the extremities) is preferred, it is also possible, in accordance with a concomitant feature of the invention, as an alternative, for the fluid-tight joint connections to be configured as separate components that are, then, fastened in a fluid-tight manner. In particular, they are attached by welding and/or adhesive bonding between the torso and associated extremity. In these alternatives, it would be possible for the fluid-tight joint connections to be optimized in terms of their fluid-sealing function and of the lead-through of the transfer measures, without account being taken of the production process of the body shell or of the extremities. Connection of the transfer measures and fastening of the joint connections to the torso and the extremities, however, would, then, give rise to additional outlay during assembly of the toy figure.

Other features that are considered as characteristic for the invention are set forth in the appended claims.

Although the invention is illustrated and described herein as embodied in a toy figure, in particular, functional doll, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
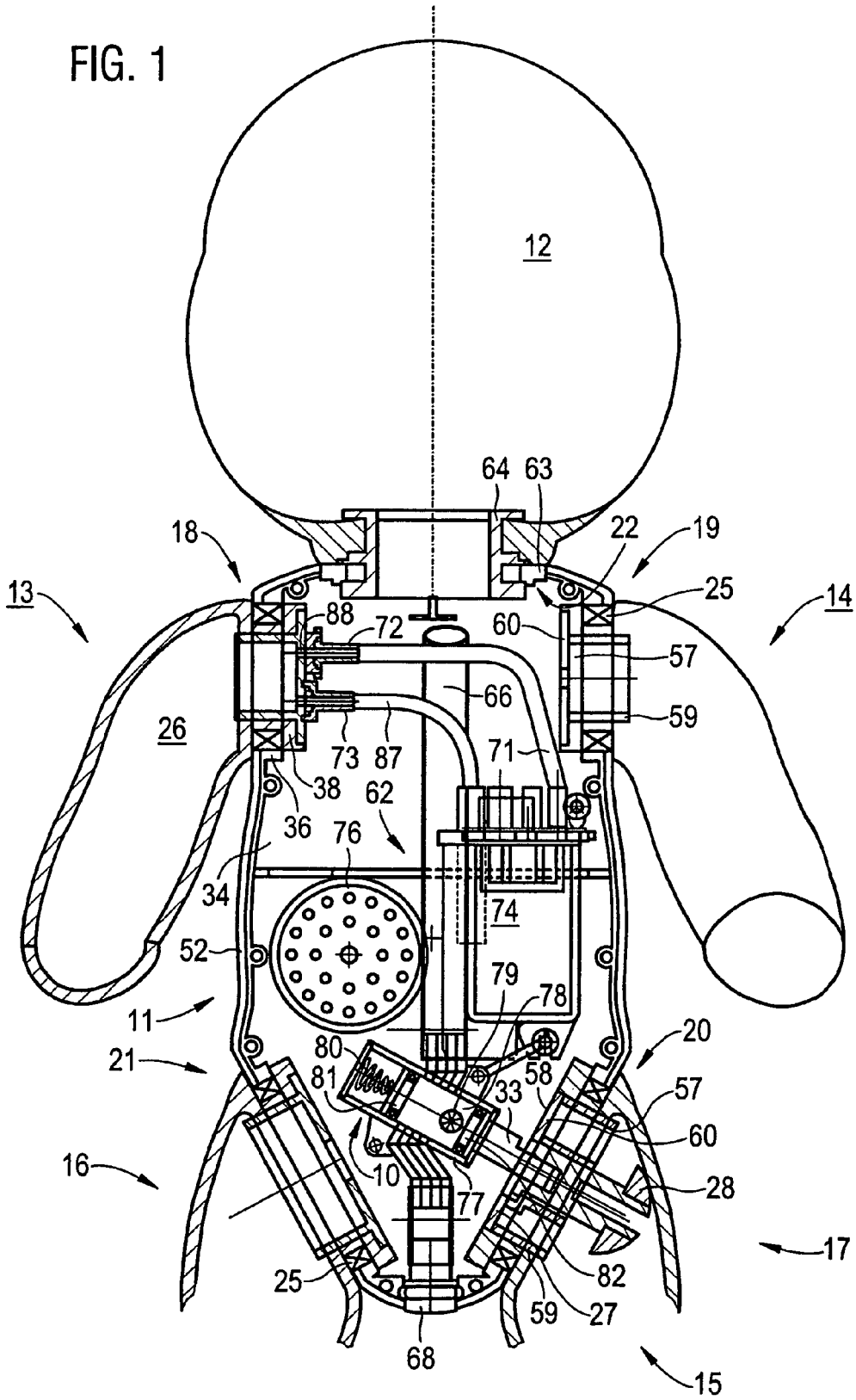
FIG. 1 is a fragmentary, cross-sectional view of a first embodiment of a functional doll according to the invention.

Referring now to the figures of the drawings in detail and first, particularly to FIG. 1 thereof, there is shown a partly sectional view of one embodiment of a functional doll. The functional doll includes a torso 11 that is made up of two half-bodies 52, 53, forms a body shell 35 and has extremities disposed on it, namely, a head 12, arms 13, 14 and legs 15, 16. A cavity 34 is formed within the torso 11.

The arms 13, 14 are connected to the torso 11 through fluid-tight joint connections 18, 19 configured as arm joints and the legs 15, 16 are connected through fluid-tight joint connections 20, 21 configured as leg joints. Finally, the head is connected to the torso 11 through a likewise fluid-tight joint connection 22 configured as a neck joint.

Accommodated within the functional doll is a functional device 17 that has a central functional section 62 provided in the torso 11 and one or more peripheral functional sections provided in the extremities 12 to 16. The peripheral functional sections, here, specifically include a compressible chamber 26, an eccentric 27, a pressure slide 28, a tearing outlet 29 (see FIG. 2B), and a food-/drink-receiver 30 (see FIG. 2B).

The central functional section 62 and the peripheral functional sections 26 to 30 are connected to one another through hydraulic and/or pneumatic and/or mechanical transfer measures that are to be explained in more detail below.

Provided between the head 12 and torso 11 are lines 31, 32 that connect the food-/drink-receiver 30 to a drink tank 65 and a storage tube 66, which serves as a food tank. The storage tube 66 serving as a food tank is oriented to run in a rectilinear manner parallel to the axis of the body of the functional doll, and is connected to a first evacuation opening 68 through a valve device 10. It, preferably, is of a material that can be twisted over a certain angle range to follow pivoting movements of the head. The drink tank 65, for its part, is connected to a second evacuation opening 70 through an outflow line 69.

The already mentioned compressible chamber 26 is formed on or in the arm 13 of the functional doll. The compressible chamber 26 is in pneumatic operative connection with the cavity 34 formed in the torso 11, such that, when the arm 13 formed from flexurally elastic material is compressed, air is forced through the joint connection 18, through a first valve connector 72 and through a hose 71, into a tears tank 74 filled with liquid. A predetermined quantity of liquid is, thus, fed out of the tears tank 74 through a line 85, into the region of the eye sockets 86 of the functional doll and flows out of one or both eyes 75. The tears tank 74 may have a refilling device that is coupled to the food-/drink-receiver 30. For the arm 13 to be allowed to relax into its starting position and, at the same time, for the volume, which increases again in the process, not to be filled with liquid from the tears tank 74, a second valve connector 73 is provided within the joint connection 18. Connected to the second valve connector 73 is an air-admission line 87 through which air can be taken in for the purpose of filling the cavity 34. First and second valve connectors 72, 73 each have non-illustrated non-return valves so that, through the first valve connector 72, air is always ejected out of the arm 13 in the direction of the tears tank 74 and, through the second valve connector 73, renewed filling of the arm 13 with air is ensured.

Finally, the cavity 34 of the torso also contains a mechanical voice 76, which is known per se in the case of toy figures. The mechanical voice 76 produces a pre-selected sound when the functional doll changes position.

The already mentioned valve device 10 can be actuated through the fluid-tight joint connection 20. The valve device 10 includes, in the first instance, a valve chamber 77 with a valve piston 78 that is mounted in a displaceable manner therein and has a through-passage opening 79 provided for the through-passage of fluid in the open position of the valve device 10. The valve piston 78 is retained in the closed position by the action of a spring 80. The valve piston 78 is sealed in a fluid-tight manner in relation to the cylindrical valve chambers 77 through two sealing disks or O-rings 81, 82.

By an actuating slide 33, which projects into the joint connection 20, and of the pressure slide 28, which is disposed in a rotationally fixed manner on this actuation slide 33, it is possible to actuate the valve piston 78, in the case of the pressure slide 28 being subjected to pressure, in a certain angular position or in a certain angle range of the leg 15 in relation to the torso 11. Outside such an angular position or the angle range, a translatory displacement of the valve piston 78 does not result in an open position of the valve device 10, which is explained in more detail in the applicant's parallel application of the same date.

Figure 2A:
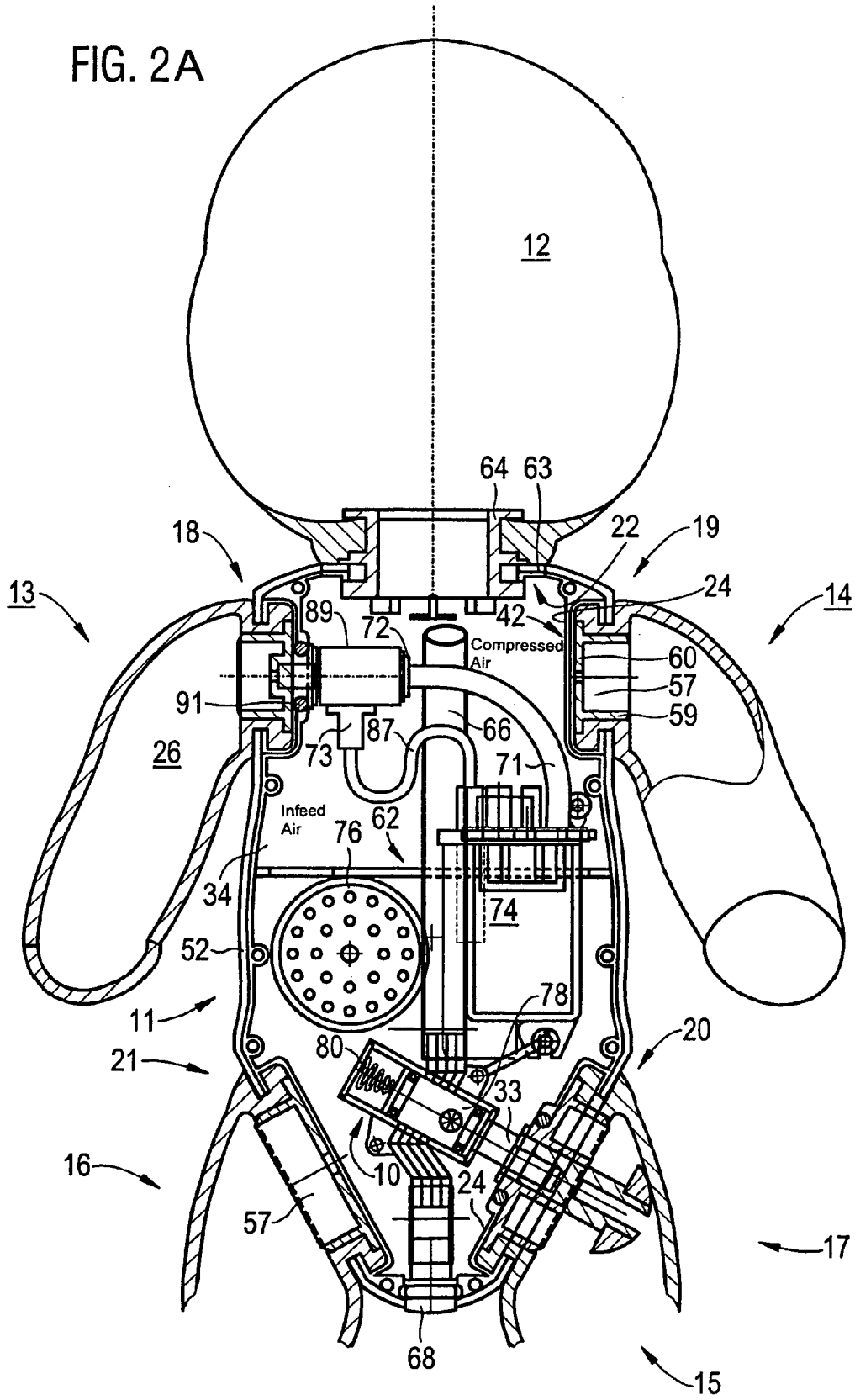
FIG. 2A is a fragmentary, cross-sectional view of a second embodiment of a functional doll according to the invention.

FIG. 2A illustrates an alternative embodiment of a functional doll as seen schematically partly in cross-section. The embodiment illustrated here differs from the embodiment explained with reference to FIG. 1 substantially by modification of the fluid-tight joint connections 18 to 22. The joint connections of the embodiment illustrated in FIG. 1 will be explained in more detail at a later stage in the text with reference to FIGS. 7 to 9. The joint connections used in the embodiment according to FIG. 2Aa are, likewise, illustrated in more detail with reference to FIG. 10A. The significant difference is that the joint connections are partitioned off in relation to the cavity 34 of the torso 11 by joint cages 42 that have corresponding sealing walls 24. In such a case, the transfer measures, in particular, an air channel 88, and the actuation slide 33 are guided in a fluid-tight manner through the sealing wall 24 of the joint cages 42, which will be described in more detail with reference to FIG. 10A.

Figure 2B:
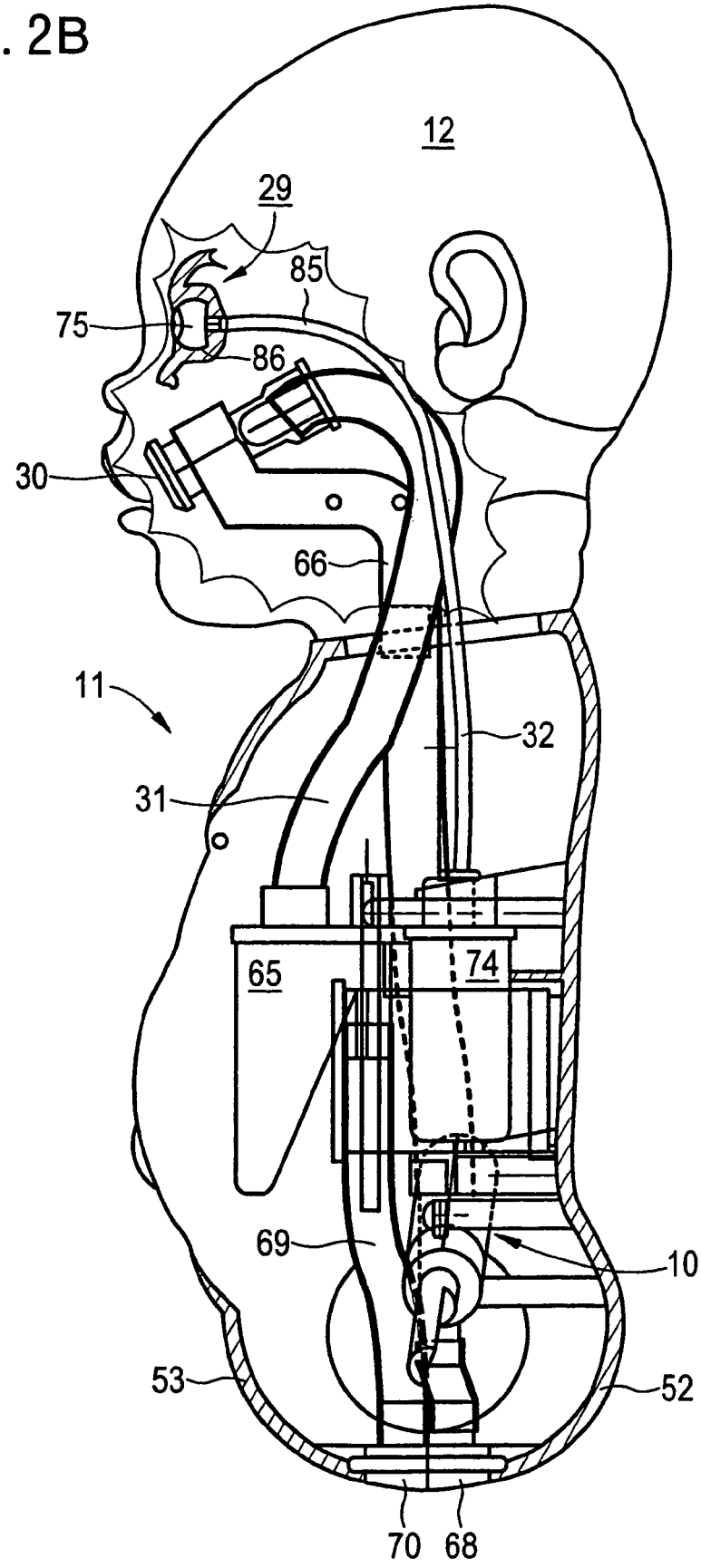
FIG. 2B is a partially cut-away and partially cross-sectional side view of the functional doll of FIG. 2A.

FIG. 2B illustrates a schematic diagram, in a lateral sectional view, of a functional doll corresponding to the embodiment shown in FIG. 1 or 2A. It can be seen here that the already mentioned lines 31, 32 and the storage tube 66 are guided through the joint connection 22 that forms the neck of the doll.

Figure 2C:
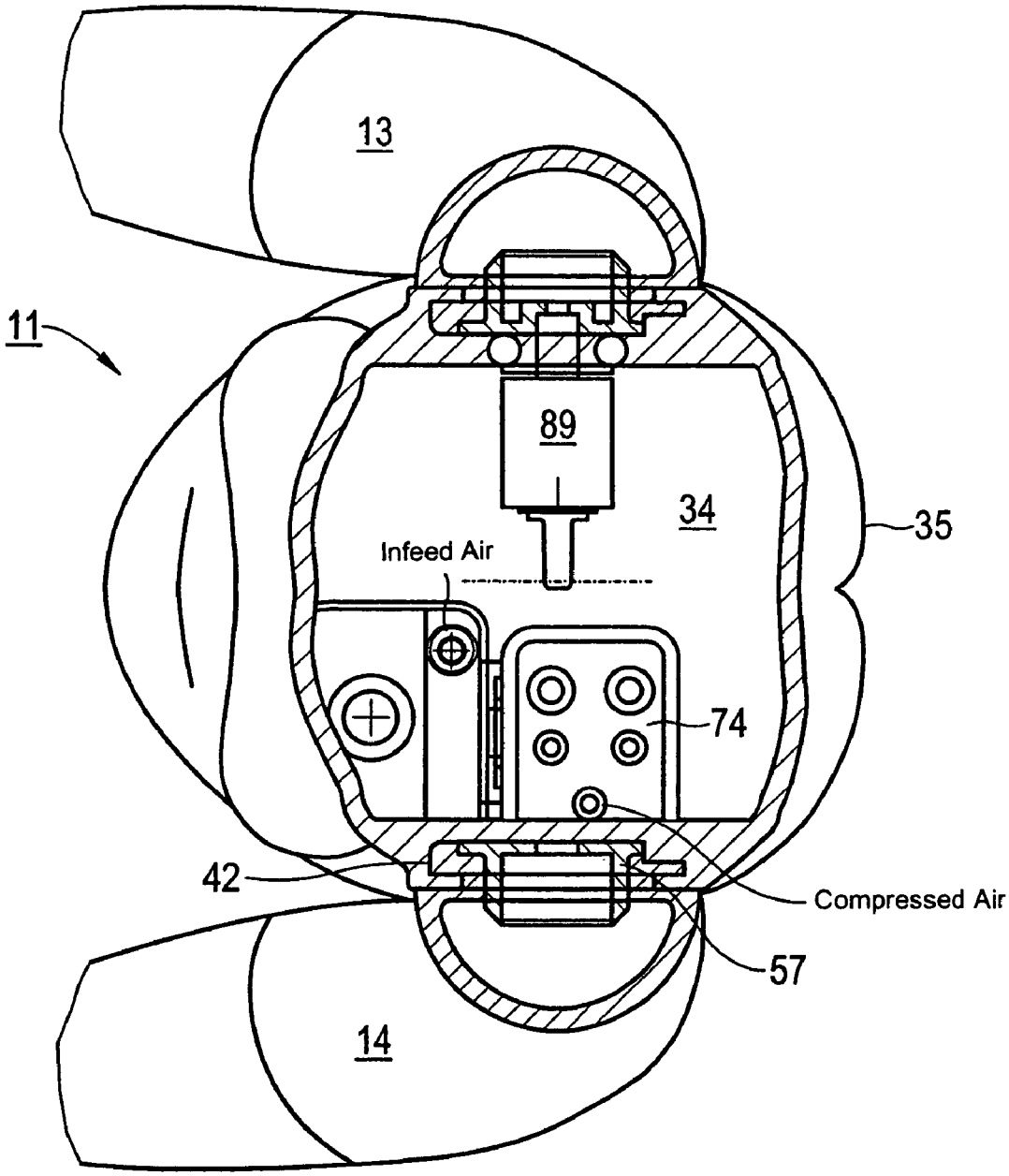
FIG. 2C is a fragmentary, cross-sectional top view through the torso of the functional doll of FIG. 2A.

FIG. 2C illustrates, in simplified form, a basic sectional view through a functional doll according to the embodiment shown in FIG. 2A. It is possible to see the joint connections 18, 19 of the arms 13, 14, these joint connections 18, 19 being retained in joint cages 42, respectively. Integrally formed on the joint connection 18 is an air-admission and air-extraction connection 89, which is connected to an air channel 88 through the joint connection 19. Located on the air-admission and air-extraction connection 89, in turn, are the first valve connector 72 and the second valve connector 73 (concealed in FIG. 2C) for the connection of a hose 71 and of the air-admission line 87, respectively. See FIG. 1.

Various preferred configurations of the fluid-tight joint connection 18 to 22 are explained in more detail hereinbelow.

Figure 3A:
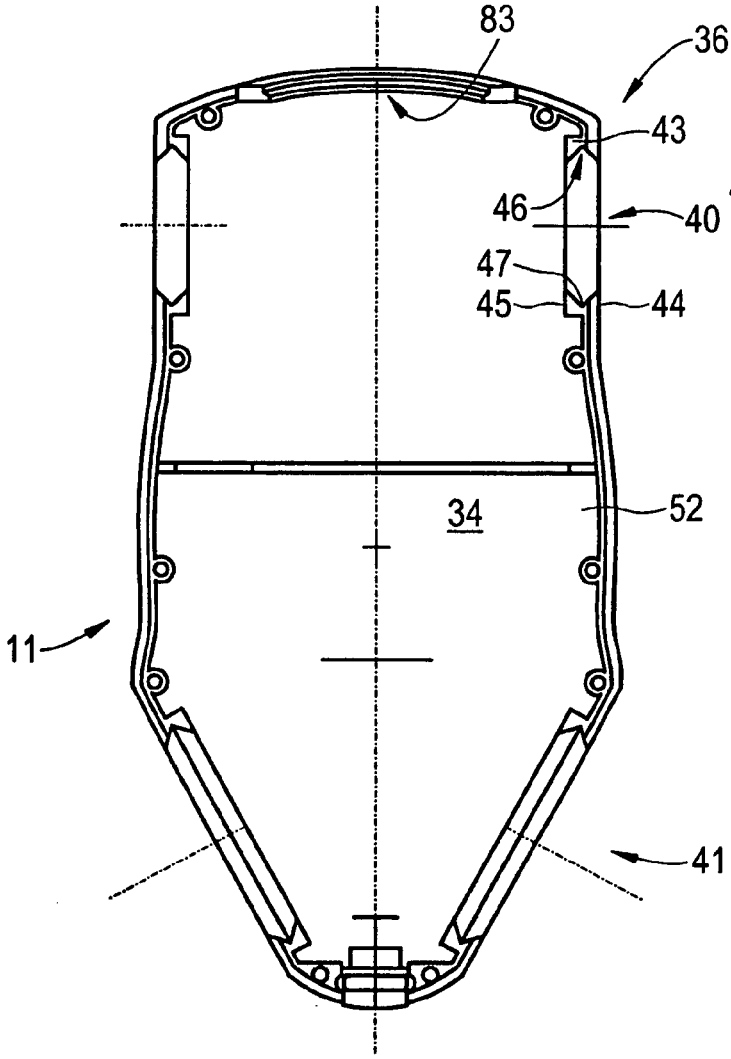
FIG. 3A is a side elevational view of one half of a torso of a functional doll according to the invention with first joint elements for fluid-tight sealing with an annular sealing device configured as an encircling sealing lip.
Figure 3B:
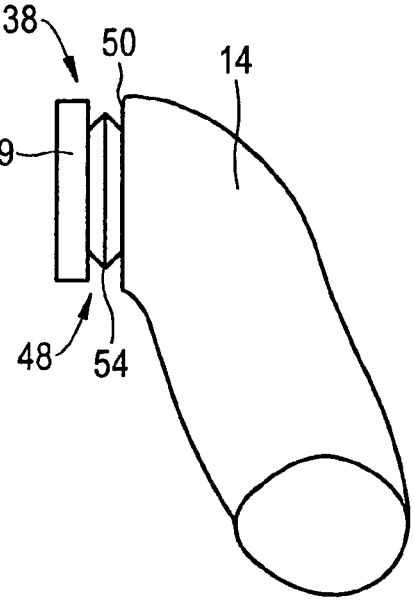
FIG. 3B is a fragmentary side elevational view of a second joint element integrally formed on an extremity and corresponding with the first joint elements of FIG. 3A.
Figure 4:
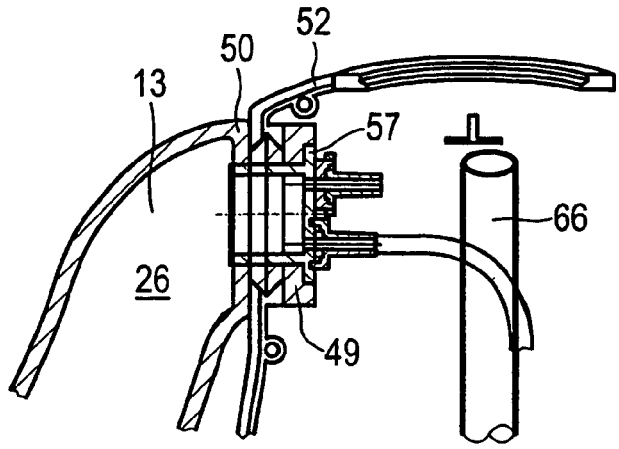
FIG. 4 is a fragmentary, enlarged cross-sectional view of a joint connection fluid-tightly sealed by an encircling sealing lip for a functional doll according to the invention.

FIGS. 3A, 3B, and 4 illustrate a first alternative configuration for a fluid-tight joint connection. The already mentioned torso 11 contains a plurality of base plates 43, in which first joint elements 36, 37, 63 (see also FIGS. 1 and 9) are provided and into which correspondingly configured second joint elements 38, 39, 64 can be inserted. Whereas, in the case of the embodiments illustrated here, the second joint elements 38, 39 of the arms 13, 14 and legs 15, 16 are integrally formed with the associated arms 13, 14 and legs 15, 16, the second joint element 64 of the head 12 is configured as a separate component, which is, then, adhesively bonded or welded to the head.

The first joint elements 36, 37, 63 include recesses 40, 41, 83 that are each provided in the base plates 43 and into which the second joint elements 38, 39, 64 can be inserted. The recesses each include an inner surface 46 that bounds the recesses along the circumference and on which an accommodating device, in particular, a tapering groove 47, is provided. In the case of the embodiment that is illustrated with reference to FIGS. 3A, 3B and 4, the groove 47 is defined by a notch with two surfaces running toward one another, a correspondingly configured sealing lip 54 of the second joint elements 38, 39 engaging in this notch. The second joint elements 38, 39 include mating plates 49, 50 that are spaced apart from one another by an encircling joint groove 48. The spacing between the joint plates 49, 50 corresponds approximately to the thickness of the base plate 43 formed on the first joint elements 36, 37, 63. The mating plates 49, 50—as can be seen from FIG. 4—engage around the base plate 43 such that the joint connections 18 to 22 is stabilized by the abutment of the mating plates 49, 50 in each case against an inner abutment surface 45 and an outer abutment surface 44 of the base plate 43. The mating plate 49 here forms the joint-side termination of an extremity 12 to 16, whereas the mating plate 50 can merge, at the periphery, into the contour of the associated extremity.

The sealing lip 54 provided in the encircling joint groove 48 is configured to correspond to the shaping of the groove 47 provided in the first joint element 36, 37, 63. The sealing lip 54, at the same time, forms a bearing surface 51 for the joint connection 18 to 22.

In the configuration that is specifically proposed here, the sealing lip 54 is formed integrally with the associated extremity 12 to 16, which reduces the production costs. To ensure the desired fluid sealing with a sufficient level of reliability, however, it is very important for the sealing lip 54 and groove 47 to be coordinated precisely with one another. It goes without saying that, in respect of a kinematic reversal, it is also possible for the groove 47 to be formed on the second joint elements 38, 39, 64 of the extremities 12 to 16 and for a correspondingly configured sealing lip 54 to be provided within the first joint elements 36, 37, 63.

Figure 5A:
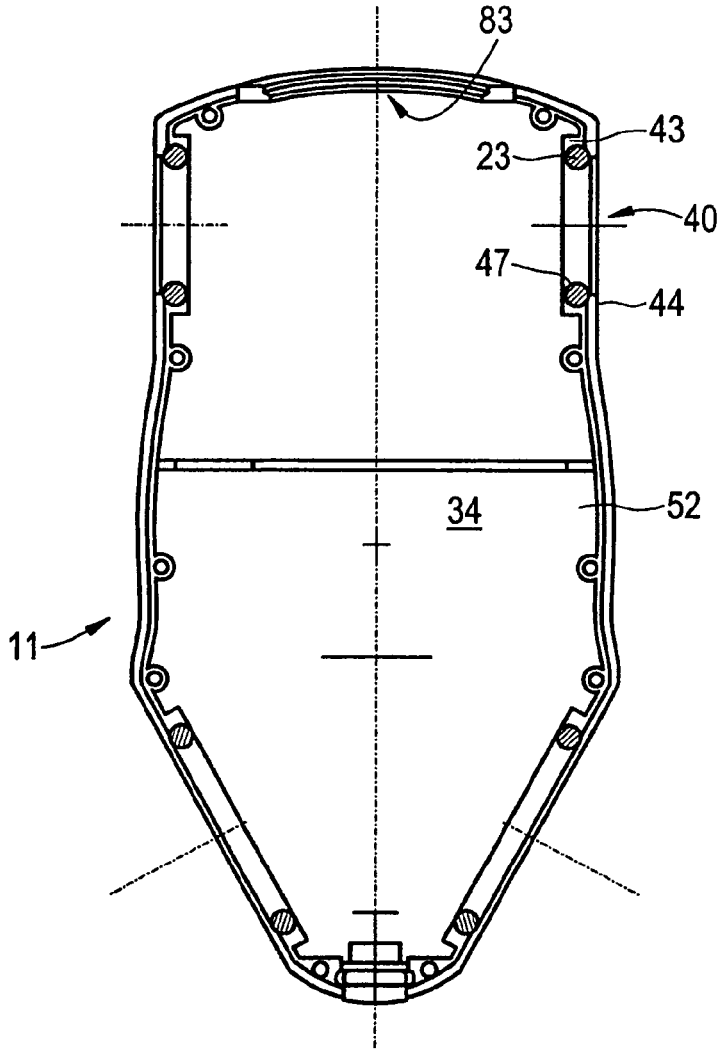
FIG. 5A is a side elevational view of one half of a torso of a functional doll according to the invention with first joint elements for fluid-tight sealing with seals configured as O-rings.
Figure 5B:
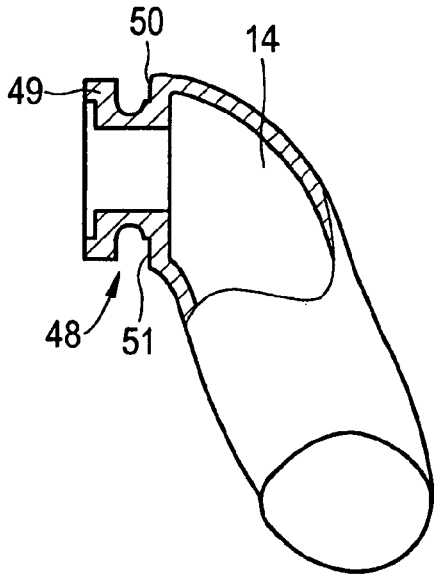
FIG. 5B is a fragmentary side elevational view of a second joint element integrally formed on an extremity and corresponding with the first joint elements of FIG. 5A.
Figure 6:
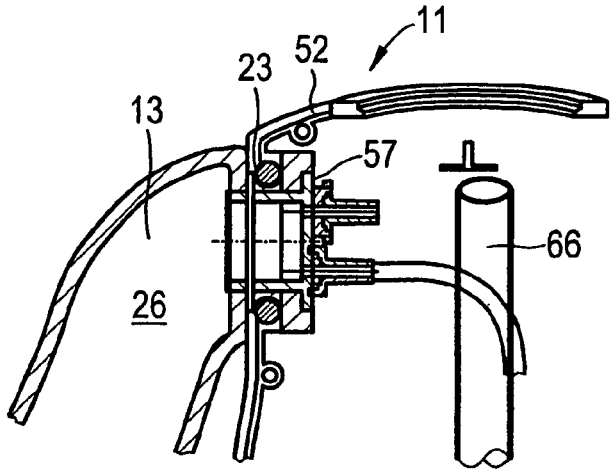
FIG. 6 is a fragmentary, enlarged, cross-sectional view of a joint connection fluid-tightly sealed with an encircling O-ring for a functional doll according to the invention.

FIGS. 5A, 5B, and 6 illustrate an alternative embodiment for fluid-tight sealing of the joint connections 18 to 22. The sealing here, rather than being achieved by a sealing lip 54 which corresponds with an appropriate groove 47, is achieved by an O-ring 23 that is effective between the first joint element 36, 37, 63 and the second joint element 38, 39, 64. The groove 47 on the inner surface 46 of the recess 40, 41, 83 of the torso 11 is shaped appropriately to stabilize the O-ring 23. Correspondingly, the encircling joint groove 48 of the second joint element 38, 39, 64 is provided with a cross-sectional shape that stabilizes the O-ring 23. At the same time, however, a bearing surface 51 possibly including a plurality of portions is defined within the encircling joint groove 48, this bearing surface sliding on the base plate 43 of the first joint elements 36, 37, 63.

The sealing by an O-ring 23 is extremely reliable and durable and also compensates for slight production tolerances that are present in certain circumstances.

Figure 7:
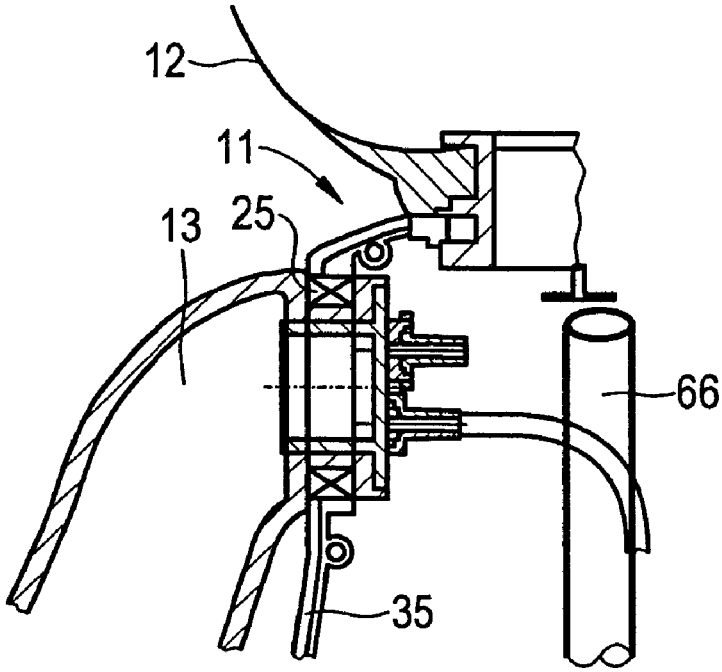
FIG. 7 is a fragmentary, enlarged, cross-sectional view of a joint connection fluid-tightly sealed with an encircling double ring for a functional doll according to the present invention.
Figure 8:
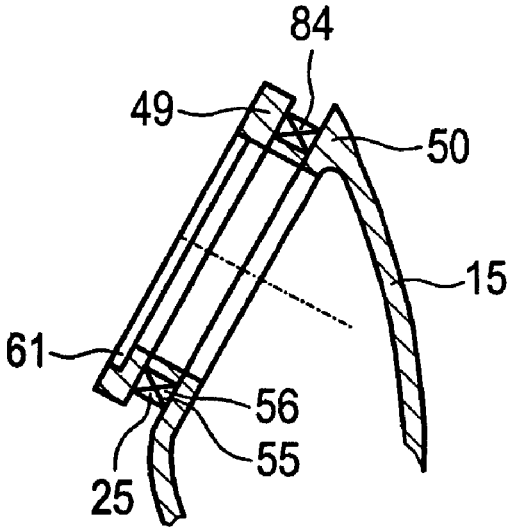
FIG. 8 is a fragmentary, enlarged, cross-sectional view of a second joint element of FIG. 7 with the encircling double ring.
Figure 9:
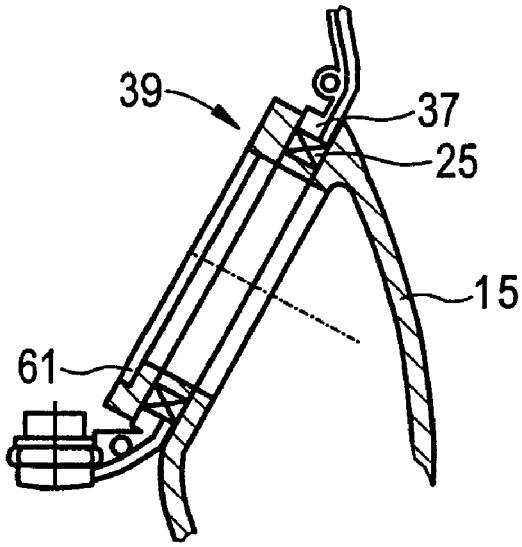
FIG. 9 is a fragmentary, enlarged, cross-sectional view of the second joint element of FIG. 8 inserted in a first joint element to form a fluid-tight joint connection.

Finally, FIGS. 7, 8 and 9 illustrate a third alternative embodiment for fluid-tight sealing of the joint connections 18 to 22 that corresponds to the sealing illustrated in FIG. 1. In this case, instead of an O-ring 23, a double ring 25, which may also be referred to as a grooved ring, is inserted, for sealing purposes, between the inner surface 46 of the recesses 40, 41, 83, that are provided within the base plate 43, and the encircling joint groove 48 of the second joint element 38, 39, 64. A correspondingly configured groove 47 on the inner surface 46 of the base plate 43 may be dispensed with, as is illustrated with reference to FIGS. 7, 8 and 9. The double ring 25 includes an outer sealing lip 55 and an inner sealing lip 56, which are connected to one another at a common base 84 and can be deflected elastically in relation to one another at their distal ends.

As is shown with reference to FIG. 8, the double ring 25, for installation purposes, may be drawn onto the second joint elements 38, 39, 64 and is retained there in the encircling joint groove 48.

To limit the deformation of the second joint elements 38, 39, 64 such that, in the case of normal usage, fluid-tight sealing of the functional doll remains ensured even if the extremities 12 to 16 are deformed, reinforcing inserts 57 (see FIGS. 1, 2A, 4, 6, 10A) are inserted in the second joint elements 38, 39, 64 in each case. These reinforcing inserts 57 include a cylindrical basic body 59 with a termination plate 60 disposed at the end thereof. The termination plate 60 has a planar front surface 58. The reinforcing inserts 57 can be inserted in each case into a correspondingly shaped recess within the second joint elements 38, 39, 64, a groove 61 being integrally formed on the periphery of the second joint elements for the purpose of accommodating the termination plate 60 in a flush manner. See, FIG. 8. The second joint elements 38, 39, 64 are, thus, stiffened precisely in their distal region, namely at the outer mating plate 49, by the termination plate 60 of the respective reinforcing insert 57.

Figure 10A:
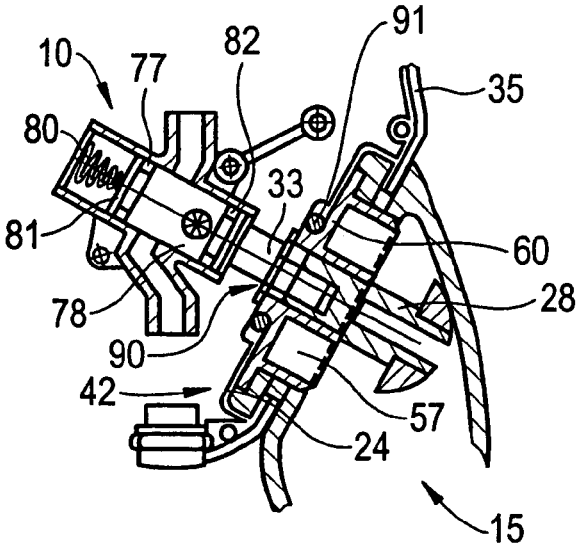
FIG. 10A is a fragmentary, enlarged, cross-sectional view of a joint connection fluid-tightly sealed with a joint cage for a functional doll according to the invention.

FIG. 10A illustrates a fluid-tight joint connection 20 that is partitioned off from the cavity 34 of the torso 11 by a joint cage 42. In the embodiment of FIG. 10A, the joint cage 42 is formed by a sealing wall 24 that has a substantially cup-like basic shape and directly adjoins the body shell 35 in the inward direction such that the recess 41, which is provided in the outward direction for the insertion of the second joint element 39, has a smaller diameter than the joint cage 42 formed by the, in this case, substantially cup-like sealing wall 24. The second joint element 39 is retained in these undercuts formed in this way, in which case, the first joint element 37 here need not just include the recess formed in the body shell 35; rather, the joint cage, which as far as possible has a corresponding configuration, can also perform a guidance function for guiding the second joint element 39, as is also illustrated with the present embodiment. However, it is not in any way imperative for the joint cage 42 to perform such a joint or guidance function. Rather, it may be sufficient for the first joint element to be formed in a base plate 43 in the body shell 35 that is provided with a recess 41 and outer abutment surface 44 and inner abutment surface 45.

The sealing walls 24 of the joint cages 42 predominantly have a sealing function. For such a purpose, they have a central opening 90 through which the transfer devices are, in this case, specifically the actuating slide 33, is, guided. An O-ring 91 is retained in the central opening 90 to seal the actuating slide 33 in a fluid-tight manner in relation to the cavity 34 of the torso 11 during a rotary or translatory movement of the actuating slide. Correspondingly—as can be seen from FIG. 2A—the air channel 88 is guided through the central opening 90 of the sealing wall 24, here, too, an O-ring 91 being provided for fluid-tight sealing between the air channel 88 and sealing wall 24.

In the case of the embodiment illustrated here, the O-ring 91, rather than butting directly against the actuating slide 33, effects sealing between the termination plate 60 of the second joint element and the sealing wall 24. As an alternative, however, it is also conceivable for the sealing to take place directly between the sealing wall 24 and the actuating slide 33.

Figure 10B:
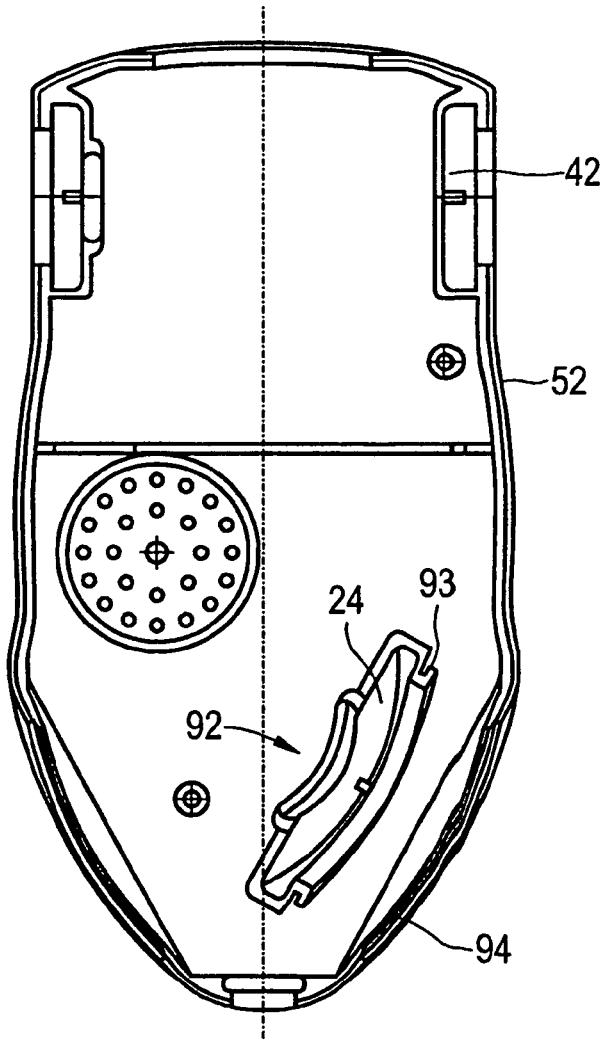
FIG. 10B is an exploded side elevational view of a half-body and a half-shell of a joint cage for a torso of a functional doll according to the invention in which half-shells of joint cages are inserted.

FIG. 10B illustrates a half-body for a torso of a functional doll in which half-shells of joint cages 42 can be inserted at the leg joints 20, 21. A half-shell 92 is provided with an outer groove 93, which can be latched onto a protrusion 94 formed on the half-body 52 of the body shell 35.

Figure 10C:
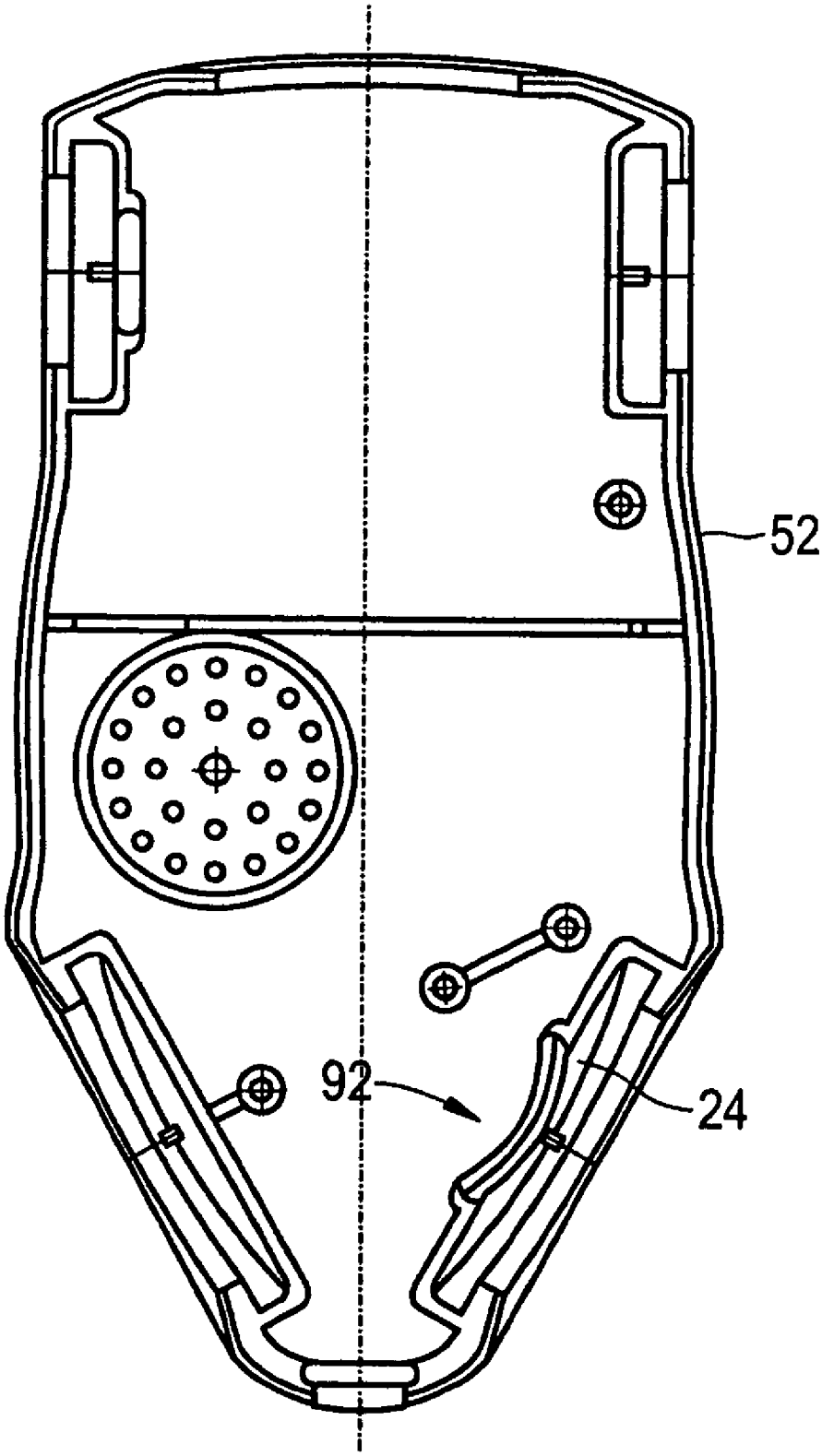
FIG. 10C is a side elevational view of a half-body of a torso for a functional doll according to the invention on which half-shells of joint cages are formed integrally.

FIG. 10C illustrates an alternative embodiment, in which the half-shells 92 for the leg joints 20, 21 are formed integrally with the half-body 52 of the body shell 35. In both embodiments illustrated, the joint cages 42 for the arm joints 18, 19 are integrally formed on the body shell 35.

I claim:

1. A toy figure, comprising:

a central torso having a body shell enclosing a cavity in an interior of said torso;

a plurality of extremities disposed on said torso, said extremities including at least one of a head, arms, and legs, at least said arms and said legs being formed from a flexurally elastic material;

an integrated functional device having:

a central functional section disposed in said torso; and at least one peripheral functional section disposed in an associated one of said extremities;

joint connections rotatably mounting at least one of said arms, said legs, and said head on said torso, at least one of said joint connections having seals fluid-tightly sealing said torso and said at least one of said arms, said legs, and said head;

a transfer device guided through at least one of said fluid-tight joint connections; and said at least one peripheral functional section being in at least one of mechanical, pneumatic, and hydraulic operative connection with said central functional section through an associated one of said fluid-tight joint connections.

2. The toy figure according to claim 1, wherein said at least one peripheral functional section is at least two peripheral functional sections disposed in two different ones of said extremities and in operative connection with said central functional section.

3. The toy figure according to claim 1, wherein said transfer device is at least one of mechanical, hydraulic, and pneumatic, and is disposed in a region of at least one of said fluid-tight joint connections.

4. The toy figure according to claim 3, wherein said transfer device is one of at least one hose, at least one air channel, and at least one actuating slide.

5. The toy figure according to claim 1, further comprising:

first joint elements at said torso;

second joint elements at said extremities, said second joint elements respectively corresponding to said first joint elements and engaging with said first, joint elements; and at least one of said first joint elements having a respective recess on said torso and into which at least one of said second joint elements can be latched.

6. The toy figure according to claim 1, further comprising:

first joint elements at said torso;

said torso having a joint cage with a sealing wall;

second joint elements being disposed at said extremities, being correspondingly configured to said first joint elements, and engaging said first joint elements;

said first joint elements respectively being formed in said joint cage and being fluid-tightly partitioned off in a direction of said cavity by said sealing wall; and said transfer device being guided through said sealing wall in a fluid-tight mount.

7. The toy figure according to claim 1, further comprising:

first joint elements at said torso;

said torso having a joint cage with a sealing wall;

second joint elements being disposed at said extremities, being correspondingly configured to said first joint elements, and engaging said first joint elements;

said first joint elements respectively being formed in said joint cage and being fluid-tightly partitioned off in a direction of said cavity by said sealing wall; and said transfer device being at least one of mechanical, hydraulic, and pneumatic, being disposed in a region of at least one of said fluid-tight joint connections, and being guided through said sealing wall in a fluid-tight mount.

8. The toy figure according to claim 6, wherein said fluid-tight mount ensures a fluid-tight rotary movement between said sealing wall and said transfer device.

9. The toy figure according to claim 6, wherein said fluid-tight mount ensures a fluid-tight rotary movement between said sealing wall and said at least one of said second joint elements.

10. The toy figure according to claim 6, wherein said joint cage act as stiffeners to effect a sealing fit that is reliable even under stressing.

11. The toy figure according to claim 6, wherein said joint cage are stiff and create a sealing fit that is reliable even under stressing.

12. The toy figure according to claim 6, wherein said sealing wall is relatively torsionally rigid as compared to said body shell.

13. The toy figure according to claim 6, wherein said joint cage is inserted as a separate component into said torso.

14. The toy figure according to claim 6, wherein:

said torso has half-bodies; and said joint cage has half shells each integrally formed on said half-bodies of said torso.

15. The toy figure according to claim 1, wherein said at least one peripheral functional section is an actuating device for triggering a given function of said functional device.

16. The toy figure according to claim 15, wherein said actuating device is one of the group consisting of a compressible chamber, an eccentric, and a pressure slide.

17. The toy figure according to claim 1, wherein said at least one peripheral functional section is an effect-producing device for ensuring a predetermined play effect.

18. The toy figure according to claim 17, wherein said effect-producing device is at least one of the group consisting of a tear outlet and a food-/drink-receiver.

19. The toy figure according to claim 1, wherein said at least one peripheral functional section is three peripheral functional sections disposed in three different ones of said extremities, each of said three peripheral functional sections being in operative connection with said central functional section.

20. The toy figure according to claim 1, wherein said three different ones of said extremities include said head, one of said arms, and one of said legs.

21. The toy figure according to claim 1, wherein:

said torso has first joint elements;

said extremities have second joint elements respectively correspondingly configured to said first joint elements;

said first joint elements engage said second joint elements; and an annular sealing device is disposed between at least one of said first joint elements and an associated one of said second joint elements and effects a fluid-tight sealing of a respective joint connection therebetween even when there is relative rotary movement of said associated ones of said first and second joint elements.

22. The toy figure according to claim 5, wherein:

said first joint elements have a disk-shaped base plate;

said base plate has:

an outer and an inner abutment surface;

a recess for receiving therein an associated one of said second joint elements; and a circular inner surface; and accommodating devices for fastening said seals on said circular inner surface.

23. The toy figure according to claim 22, wherein:

said disk-shaped base plate is integrally formed with said torso and is in at least two parts; and said torso is in at least two parts.

24. The toy figure according to claim 22, wherein said accommodating devices have an encircling groove.

25. The toy figure according to claim 5, wherein said second joint elements have an encircling joint groove and two mating plates spaced apart from one another at a predetermined distance by said joint groove, said joint groove being coordinated in terms of its shape with said seals.

26. The toy figure according to claim 25, wherein said joint groove has a bearing surface therewithin for receiving said seals.

27. The toy figure according to claim 1, wherein said seals are O-rings.

28. The toy figure according to claim 5, wherein said seals are formed as an encircling sealing lip disposed, on a torso side thereof, on one of said first joint element and said second joint element, associated with an extremity.

29. The toy figure according to claim 5, wherein said seals are integrally formed with one of said first and second joint elements.

30. The toy figure according to claim 1, wherein said seals are cross-sectionally U-shaped double rings with an outer and an inner sealing lip.

31. The toy figure according to claim 1, wherein said body shell of said torso is formed from two half-bodies welded to one another.

32. The toy figure according to claim 31, wherein said torso has a length of over 150 mm.

33. The toy figure according to claim 31, wherein said torso has a length of over 160 mm.

34. The toy figure according to claim 31, wherein said torso has a length of over 170 mm.

35. The toy figure according to claim 1, further comprising reinforcing inserts, at least one of said arms and legs being stiffened in a region of said joint connections by said reinforcing inserts.

36. The toy figure according to claim 35, wherein said reinforcing inserts have an outwardly oriented planar front surface.

37. The toy figure according to claim 35, wherein said reinforcing inserts have a cylindrical basic body with a termination plate joined thereto and having a larger dimension in a radial direction thereof.

38. The toy figure according to claim 37, wherein said termination plate can be inserted into a correspondingly configured, encircling groove of an associated one of said joint connections.

39. The toy figure according to claim 1, wherein said fluid-tight joint connections are separate components fastened in a fluid-tight manner between said torso and associated one of said extremities.

40. The toy figure according to claim 1, wherein said fluid-tight joint connections are attached by at least one of welding and adhesive bonding.

41. The toy figure according to claim 1, wherein the toy figure is a functional doll.

42. The toy figure according to claim 1, wherein said torso, said extremities, said functional device, said connections, said seals, and said transfer device form a functional doll.

43. The toy figure according to claim 6, wherein said joint cage is integrally formed in said torso.

* * * * *